US006468706B2

(12) United States Patent
Matsuda et al.

(10) Patent No.: US 6,468,706 B2
(45) Date of Patent: Oct. 22, 2002

(54) TWO-COMPONENT DEVELOPER, CONTAINER FILLED WITH THE TWO-COMPONENT DEVELOPER, AND IMAGE FORMATION APPARATUS

(75) Inventors: Hiroaki Matsuda, Tokyo (JP); Masanori Suzuki, Tokyo (JP); Akemi Sugiyama, Tokyo (JP); Hiroto Higuchi, Tokyo (JP); Tsunemi Sugiyama, Tokyo (JP); Fumihiro Sasaki, Tokyo (JP); Yasuaki Iwamoto, Tokyo (JP); Hiroshi Nakai, Tokyo (JP); Kumi Hasegawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/862,436

(22) Filed: May 23, 2001

(65) Prior Publication Data

US 2002/0006567 A1 Jan. 17, 2002

(30) Foreign Application Priority Data

May 23, 2000 (JP) ..... 2000-151041
Aug. 7, 2000 (JP) ..... 2000-239220

(51) Int. Cl.[7] ..... G03G 9/087

(52) U.S. Cl. ..... 430/108.6; 430/110.4; 430/111.41; 399/265

(58) Field of Search ..... 430/108.6, 110.4, 430/111.41; 399/265

(56) References Cited

U.S. PATENT DOCUMENTS

| | | | | |
|---|---|---|---|---|
| 4,758,489 | A | 7/1988 | Tomita et al. | |
| 4,908,290 | A | 3/1990 | Watanabe et al. | |
| 4,956,258 | A | 9/1990 | Watanabe et al. | |
| 4,980,258 | A | 12/1990 | Aoki et al. | |
| 5,168,028 | A | 12/1992 | Nanya et al. | |
| 5,225,303 | A | 7/1993 | Tomita et al. | |
| 5,288,577 | A | 2/1994 | Yamaguchi et al. | |
| 5,368,972 | A | 11/1994 | Yamashita et al. | |
| 5,380,616 | A | 1/1995 | Aoki et al. | |
| 5,403,690 | A | 4/1995 | Kuramoto et al. | |
| 5,429,901 | A | 7/1995 | Muto et al. | |
| 5,554,478 | A | 9/1996 | Kuramoto et al. | |
| 5,840,456 | A | 11/1998 | Tomita et al. | |
| 5,879,849 | A | 3/1999 | Sawada et al. | |
| 5,882,832 | A | 3/1999 | Tosaka et al. | |
| 5,972,547 | A | * 10/1999 | Yaguchi et al. | 430/45 |
| 6,004,715 | A | 12/1999 | Suzuki et al. | |
| 6,010,814 | A | 1/2000 | Kotsugai et al. | |
| 6,066,430 | A | * 5/2000 | Tsutsui et al. | 430/120 |
| 6,074,794 | A | 6/2000 | Fushimi et al. | |
| 6,074,795 | A | 6/2000 | Watanabe et al. | |
| 6,090,515 | A | * 7/2000 | Tomiyama et al. | 430/106 |
| 6,103,441 | A | 8/2000 | Tomita et al. | |
| 6,124,067 | A | * 9/2000 | Mikuriya et al. | 430/106.6 |
| 6,180,298 | B1 | 1/2001 | Kuroda et al. | |
| 6,183,926 | B1 | 2/2001 | Kuroda et al. | |
| 6,228,550 | B1 | 5/2001 | Matsuda et al. | |
| 6,258,502 | B1 | 7/2001 | Nakamura et al. | |
| 6,303,258 | B1 | 10/2001 | Katoh et al. | |

FOREIGN PATENT DOCUMENTS

| | | | |
|---|---|---|---|
| JP | SHO 51-3238 | A | 1/1976 |
| JP | SHO 51-3244 | A | 1/1976 |
| JP | SHO 54-72054 | A | 6/1979 |
| JP | SHO 58-23032 | A | 2/1983 |
| JP | SHO 58-129437 | A | 8/1983 |
| JP | SHO 58-144839 | | 8/1983 |
| JP | SHO 59-52255 | A | 3/1984 |
| JP | SHO 59-222847 | A | 12/1984 |
| JP | SHO 60-112052 | A | 6/1985 |
| JP | SHO 61-204646 | A | 9/1986 |
| JP | SHO 63-41864 | A | 2/1988 |
| JP | SHO 63-41865 | A | 2/1988 |
| JP | HEI 1-225962 | A | 9/1989 |
| JP | HEI 2-877 | A | 1/1990 |
| JP | HEI 2-222966 | A | 9/1990 |
| JP | HEI 2-281280 | A | 11/1990 |
| JP | 9-325611 | | 12/1997 |
| JP | HEI 10-198068 | A | 7/1998 |
| JP | 11-119468 | | 4/1999 |
| JP | 11-282213 | | 10/1999 |

* cited by examiner

*Primary Examiner*—John Goodrow
(74) *Attorney, Agent, or Firm*—Oblon, Spivak, McClelland, Maier & Neustadt, P.C.

(57) ABSTRACT

A two-component developer consists of a toner, which contains at least a resin and a colorant and to which an external additive is added, and a carrier. This two-component developer has the toner that has a number average molecular weight (Mn) of 3,000 or less and contains particles having a molecular weight of 1,000 or less at 40 number % or more, and also has the carrier that satisfies general formula (1) as follows:

$$3{,}000{,}000 \leqq \sigma 1000 \times Dc^3 \leqq 20{,}000{,}000 \quad (1)$$

where $\sigma_{1000}$ represents a magnetization (emu/g) of a carrier at 1,000 oersted, and Dc represents volume average particle diameter ($\mu$m) of the carrier.

20 Claims, 3 Drawing Sheets

TWO-COMPONENT DEVELOPER, CONTAINER FILLED WITH THE TWO-COMPONENT DEVELOPER, AND IMAGE FORMATION APPARATUS

FIELD OF THE INVENTION

The present invention relates to an electrostatic image developer used for developing an electrostatic latent image formed on the surface of a latent image carrier body in an electrophotographic method, an electrostatic recording method, and an electrostatic printing method, or the like. More particularly, this invention relates to the electrostatic image developer having a toner and a carrier.

BACKGROUND OF THE INVENTION

In association with social movement of energy saving in recent years, such movement has become active also in the electrophotographic field. A fixing part in particular of electrophotographic equipment consumes a large amount of energy. Therefore, studies in this part have been carried out so as to attain mechanically low power consumption. Regarding toner as a supply, development of toner adequate for an energy-saving fixing device has been urged as well. As measures directed toward achievement of energy saving in the fixing device due to toner, the followings are most popular.

For example, some of binder resins for toner is targeted to stabilize fixability at a low temperature by using a resin having low molecular weight. Although energy saving can be achieved because of low-temperature fixability of toner, the toner itself or toner components may be melted in many cases on the surface of a carrier (hereafter referred to as toner spent) particularly when the binder resin of the toner has a large amount of components having low molecular weight. The carrier surface is soiled with this toner spent, and the charged sites of the carrier decrease, which causes the amount of triboelectric charge as a two-component developer to vary. Resultantly, inconvenience such as occurrence of variation in image density or fog may occur.

In Japanese Patent Application Laid-Open No. 10-198068, detailed description on toner molecular weight for suppression of toner spent has been disclosed. However, low-energy consumption for the fixing device could not sufficiently be achieved with the range of the toner molecular weight in this publication.

Further, as image forming devices such as electrophotographic copiers have been widely used, the purpose of their use also becomes widely, demands of the market for high-definition and high-quality images are increasing. In this technological field, such attempt that toner particle diameter is made smaller to achieve higher quality of image has been made. However, smaller particle diameter makes the surface area per unit weight increase, and the amount of electrification on toner tends to increase. Therefore, lower image density and deterioration of durability are what may be concerned about. In addition, because of the large amount of electrification on toner, adhesion of toner particles is strong and fluidity is lowered. Accordingly, there comes up some problems in stability of toner supply and impartation of triboelectric charge to toner to be supplied. In general, the tendency of increase in the amount of electrification becomes more significant particularly when polyester-based binder of high chargeability is used.

Some types of developers have been proposed for obtaining improved image quality. In Japanese Patent Application Laid-Open No. 51-3244, a nonmagnetic toner for improving image quality obtained by restricting a particle size distribution has been proposed. The toner contains mainly toner particles having particle diameter of 8 to 12 μm, which are comparatively coarse. Therefore, according to the analysis of the inventors, uniform "deposition" of the toner onto a latent image is difficult with this particle size. Further, the toner has properties such that the particles of 5 μm or less are contained at 30 number % or less, and the particles of 20 μm or more are contained at 5 number % or less. Therefore, the particle size distribution is broad, which also tends to decrease the degree of uniformity. In order to form a sharp image using the toner having such coarse toner particles and broad particle size distribution, it is required to increase the apparent image density by embedding space of inter-toner particles through heavy superimposition of the particles on each other. Resultantly, this invention also has a problem such that the amount of toner consumption required for attaining the predetermined image density increases.

Japanese Patent Application Laid-Open No. 54-72054 has made the proposal of a nonmagnetic toner having particle size distribution sharper than the former one. The size of particles having an intermediate weight is as coarse as a range of 8.5 to 11.0 μm. Therefore, this toner is still in need of some improvements as high-resolution toner. Further, Japanese Patent Application Laid-Open No. 58-129437 has made the proposal of a nonmagnetic toner having 6 to 10 μm average particle diameter and 5 to 8 μm diameter in most frequency particles. However, the toner contains a small amount of particles of 5 μm or less at 15 number % or less, which means this invention has little effect on a sharp image.

In accordance with studies by the inventors, it is found that the toner particles of 5 μm or less sharply reproduce the edge of a latent image and have a main function for solid "deposition" of the toner onto the entire latent image. Particularly, in the electrostatic latent image on a photoreceptor, the edge part as its outline has electric field strength stronger than its internal part because the lines of electric force are concentrated on the edge part. Therefore, sharpness of image quality is determined depending on the quality of the toner particles collecting on this part. According to the inventors, it is found that the amount of the particles of 5 μm or less is effective in solution of the problem on sharpness of image quality. In Japanese Patent Application Laid-Open No. 2-222966, a toner, that contains toner particles having particle diameter of 5 μm or less at 15 to 40 number %, has been proposed. It is thought that this invention has achieved significantly improved image quality. However, further improved image quality is desired.

In Japanese Patent Application Laid-Open No. 2-877, a toner, that contains toner particles having particle diameter of 5 μm or less at 17 to 60 number %, has been proposed. The image quality and image density are surely stabilized with this toner. However, it is also found that it is difficult to constantly obtain a predetermined level of image quality. That is because the particle size distribution of the toner varies when an original like a photographic document, that requires a large amount of toner consumption, is repeatedly printed. Further, all the above-mentioned inventions relate only to a nonmagnetic toner developer, with which high image quality has been obtained in terms of reproducibility of fine lines or the like, but measures against background dirt or the like have not been improved yet.

On the other hand, inventions, which suggest average particle diameter and particle size distribution of carrier, have been disclosed in Japanese Patent Application Laid-Open No. 51-3238, Japanese Patent Application Laid-Open No. 58-144839, and Japanese Patent Application Laid-Open No. 61-204646. Japanese Patent Application Laid-Open No. 51-3238 mentions the coarse particle distribution.

However, this invention does not particularly disclose the magnetic property having a close relation with developing performance of the developer or conveyability in the developing device. Further, the carrier in the example contains particles of 250 mesh or more at about 80 weight % or more based on the total weight of the carrier, and its average particle diameter is 60 $\mu$m or more.

Japanese Patent Application Laid-Open No. 58-144839 has disclosed merely the average particle diameter, and neither mentions the amount of fine powder that exerts an effect on carrier adhesion to a photoreceptor and also the amount of coarse powder that exerts an effect on sharpness of an image, nor describes the distribution of the powder in detail. Further, the invention of Japanese Patent Application Laid-Open No. 61-204646 has disclosed a combination of a copier and an appropriate developer as its essence, but has not particularly described particle size distribution and magnetic properties of the carrier. The invention does not even disclose why this developer is effective to the copier. The ferrite carrier disclosed in Japanese Patent Application Laid-Open No. 58-23032 is based on a porous material that has many voids, and such carrier makes an edge effect easily occur and has insufficient durability.

Such a developer as follows has been long awaited. The developer is one with which continuous duplication of an image having a large area can be carried out using a small amount of the developer, and which can satisfy the property that the edge effect does not occur after the durability passes. The studies in the developer and the carrier have been still continued, and much-awaited carrier is as follows. This carrier has the ability to continuously copy an image having an image area of 20% or more that is almost a solid image, and also the abilities to reduce the edge effect and keep evenness of image density in a sheet of copied matter.

Japanese Patent Application Laid-Open No. 02-281280 has made the proposal of a carrier having a narrow particle size distribution with the controlled amount of existence of fine powder and amount of existence of coarse powder. The carrier with the improved developing property has been achieved in the above-mentioned invention.

However, as mentioned above, the demands of the market for higher definition and higher quality images of copiers are increasing, and in this technical field, an attempt to achieve a higher degree of image quality has been made by reducing the particle diameter of toner. However, there comes up a problem that a surface area per unit weight increases as the particle diameter becomes finer and the amount of electrification on toner tends to increase, which may cause the image density to be lowered and durability to be deteriorated.

As explained above, prevention of the image density from being lowered and the durability from deterioration due to finer toner particle diameter, or further finer diameter of carrier for improving developing efficiency has been studied. However, the current situation indicates that such carrier has not quality sufficient enough to follow variations in the charge amount due to improved durability.

The inventors have found the facts as follows after carefully studying image density, reproducibility of a high light, and reproducibility of fine lines in the image forming method. That is, higher degree of image quality excellent in high degree of image density, reproducibility of a highlight and reproducibility of fine lines, etc. can be achieved when both a toner having a specific particle size distribution and a spherical carrier are used. Further, when specific titania particles as an external additive are contained in the toner, improved developer fluidity and stable environmental characteristic can be achieved.

Disadvantages, that occur when respective particle diameter of the carrier and the toner is made smaller, include cases that fluidity as a developer is lowered and the developer in a developing device is hard to be circulated. For the countermeasures against these troubles, the condition of the device may be changed such that stirring strength in the developing device is enhanced. However, here occurs a problem such that the change of the device condition makes the durability of the developer shortened. Therefore, this change is not preferable. To solve the problem, it is important to keep a predetermined level of fluidity as a developer. Some means are conceivable in order to keep fluidity of the developer.

As one of the means, the inventors have found that controlling a shape of carrier is effective. That is, increasing the degree of sphericity of carrier particles makes the fluidity improved.

The sphericity of a carrier has been described in Japanese Patent Application Laid-Open No. 59-222847. However, definition of the degree of sphericity is not clear, so that it is impossible to know which level of the sphericity is actually available.

In Japanese Patent Application Laid-Open No. 63-41864, the sphericity value $\Psi Z$ of a carrier is defined, but this definition works only in a developing method based on coating by an elastic blade, which is different from the present invention.

The inventors have found the fact as follows. That is, in order to improve the fluidity of a developer, it is also effective that resin having low-surface energy is further contained in coating resin for the carrier coated with the resin.

Inventions that define the fluidity of a carrier have been disclosed in Japanese Patent Application Laid-Open No. 63-41865 and Japanese Patent Application Laid-Open No. 01-225962. However, when the carrier in the present invention smaller than the conventional carrier is used, measurement by JIS-Z2502 is difficult, and reproducibility of an image is hard to be obtained.

Further, the publications have restriction only to the carrier, and do not include electrification on the toner side and influence of other additives. Accordingly, even if the fluidity of a carrier is set to a predetermined level, a sufficient result is not always obtained in a practical case. Therefore, it is important to pay attention on the fluidity of developer including electrification and its influence on the surface of toner, or the like.

SUMMARY OF THE INVENTION

It is an object of this invention to provide a two-component developer using a low-temperature fixing toner, in which toner spent on the surface of a carrier is presented in a small amount, the sufficient amount of triboelectric charge is imparted, and the triboelectrification is stabilized.

Another object of this invention is to provide a two-component developer which is clear and excellent in gradation.

Still another object of this invention is to provide a two-component developer which is excellent in conveyability in a developing device.

A further object of this invention is to provide a two-component developer whose performance is not changed after a long period of its use.

A still further object of this invention is to provide a two-component developer whose performance is not changed even by environmental variations.

A still further object of this invention is to provide a two-component developer with which high image density can be obtained with a minimum consumption of this developer.

A still further object of this invention is to provide a two-component developer with which a toner image excellent in resolution, gradation, and reproducibility of fine lines can be formed in an image formation apparatus based on digital image signals.

According to this invention, firstly, the two-component developer as follows is provided. This two-component developer consists of at least a toner and a carrier, in which number average molecular weight (Mn) of the toner is 3,000 or less, and molecules having a molecular weight of 1,000 or less are contained at 40 number % or more, and the carrier satisfies general formula (1) as follows:

$$[2]\ 3{,}000{,}000 \leqq \sigma_{1000} \times Dc^3 \leqq 20{,}000{,}000 \quad (1)$$

where $\sigma_{1000}$ represents a magnetization (emu/g) of a carrier at 1,000 oersted, and Dc represents volume average particle diameter ($\mu$m) of carrier.

Secondly, the two-component developer according to the first description is provided as follows. In this developer, the volume average particle diameter (Dc) of the carrier is not larger than 60 $\mu$m.

Thirdly, the two-component developer according to the first or second description is provided as follows. In this developer, the toner is a magnetic toner, which has weight average particle diameter of 3 to 7 $\mu$m, and contains toner having particle diameter of 5.04 $\mu$m or less at more than 40 number %, toner having particle diameter of 4 $\mu$m or less at 10–70 number %, toner having particle diameter of 8 $\mu$m or more at 2 to 20 volume %, and toner having particle diameter of 10.08 $\mu$m or more at 6 volume % or less.

Fourthly, the two-component developer according to any of the first to third descriptions is provided as follows. In this developer, the carrier has volume average particle diameter of 15 to 45 $\mu$m, and contains carrier particles smaller than 22 $\mu$m at 10 to 20%, carrier particles smaller than 16 $\mu$m at 3% or less, carrier particles of 62 $\mu$m or more at 2 to 15%, and carrier particles of 88 $\mu$m or more at 2% or less.

Fifthly, the two-component developer according to any of the first to fourth descriptions is provided as follows. In this developer, a saturation magnetization to an applied magnetic field with 1,000 oersted of the carrier is 40 to 120 emu/g, residual magnetization is not more than 10 emu/g, and a coercive force is not more than 60 oersted.

Sixthly, the two-component developer according to any of the first to fifth descriptions is provided as follows. In this developer, fluidity of the developer is 25 to 55 (sec/50 g).

Seventhly, the two-component developer according to any of the first to sixth descriptions is provided as follows. In this developer, the external additive is titania particles whose average particle diameter is 0.01 to 0.2 $\mu$m, hydrophobic degree is 20 to 98%, and light transmittance in 400 nm is not less than 40%.

Eighthly, the two-component developer according to any of the first to seventh descriptions is provided as follows. In this developer, the carrier particle has a shape such that a ratio between its length (X) and breadth (Y) is in a range from 0.6 to 1.0 on the average when the carrier particle is regarded as a plane image.

Ninthly, the container filled with the two-component developer according to any of the first to eighth descriptions is provided.

Tenthly, the image formation apparatus with the built-in container according to the ninth description is provided.

Other objects and features of this invention will become apparent from the following description with reference to the accompanying drawings.

BRIEF DESCRIPTION OF THE DRAWINGS

FIG. 2A is a plan view and

FIG. 2B is a front view partially showing the device in cross section; and

DETAILED DESCRIPTION OF THE PREFERRED EMBODIMENT

Figure 1:
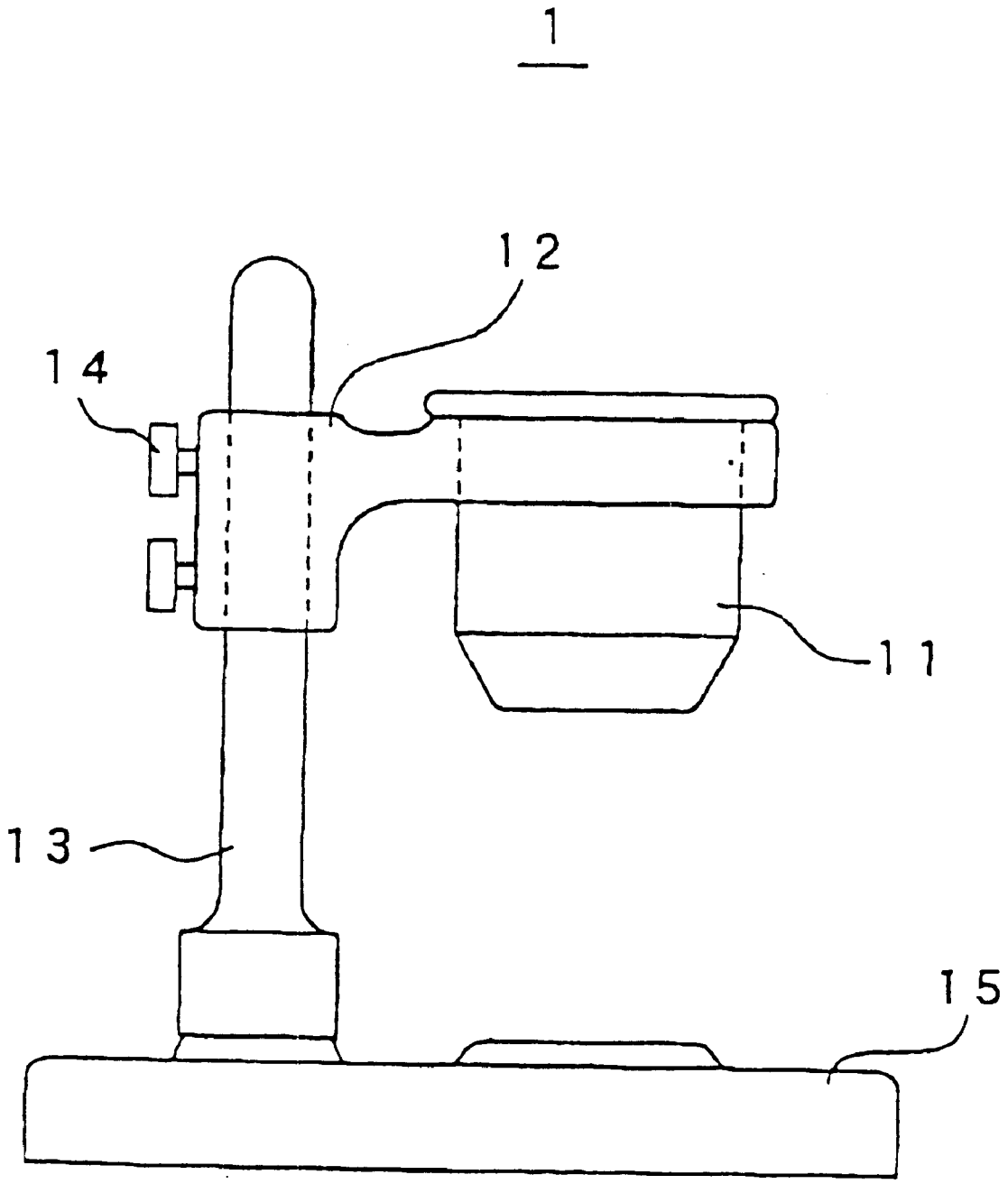
FIG. 1 is a front view of a developer-fluidity measuring device.

A preferred embodiment of this invention will be explained in detail below.

Regarding the low-temperature fixing toner according to this invention, it is essential that number average molecular weight (Mn) of the toner is 3,000 or less and molecules having a molecular weight of 1,000 or less are contained at 40 number % or more. Based on this toner structure, sufficient fixability can be obtained even when a fixing temperature is lowered by 20° C. or more than that in the conventional art. Conventionally, the toner had the number average molecular weight Mn larger than 3,000 and molecules having a molecular weight of 1,000 or less at less than 40 number % because of necessity of satisfying spent resistance as a developer.

The inventors have studied on such a toner that easily changes to toner spent onto the carrier surface. As a result, it is recognized that molecules having a molecular weight of 1,000 or less largely exert an effect on the toner spent. It is recognized that, if the molecules having a molecular weight of 1,000 or less are contained at 40 number % or more in particular, the toner spent tends to occur significantly. Therefore, the inventors have studied so as to enable provision of such a two-component developer excellent in the stability of triboelectric charge by using a carrier excellent in spent resistance while using the low-temperature fixing toner.

Respective values of the weight-average molecular weight Mw and the number average molecular weight Mn can be obtained by various methods. Although there is a slight difference depending on a difference between measuring methods, in this invention, these values are defined as those obtained according to the measuring method as follows. That is, weight-average molecular weight Mw and number average molecular weight Mn are measured under the condition explained below by gel permeation chromatography (GPC). Measurement is carried out by flowing a solvent (tetrahydrofuran) at a flow rate of 1.2 ml/min at a temperature of 40° C., and injecting a tetrahydrofuran sample solution having a concentration of 15 ml/5 ml thereinto by 3 mg as sample weight. For measuring molecular weight of a sample, a measuring condition as follows is selected. That is, the molecular weight of this sample is included in a range in which logarithm of a molecular weight of a calibration curve and a count number become a straight line. This calibration curve is prepared by several types of monodispersed polystyrene standard samples. Reliability of the result of measurement can be assured by obtaining the following values of an NBS 706 polystyrene standard sample carried out under the measuring conditions:

Weight-average molecular weight Mw=28.8×104

Number average molecular weight Mn=13.7×104

As a column of GPC to be used, any column may be employed if it satisfies the conditions. More specifically, for example, TSK-GEL, GM H6 (manufactured by Toyo Soda Co.) maybe used. The solvent and the measuring temperature are not restricted by the described ones, but may be changed to appropriate conditions.

A method for achieving a carrier excellent in toner spent resistance will be introduced below. The inventors express the magnitude of magnetization per carrier particle as follows, and have found that such a carrier can be achieved by reducing the value smaller.

$$[3]\ 3{,}000{,}000 \leqq \sigma_{1000} \times Dc^3 \leqq 20{,}000{,}000 \quad (1)$$

where $\sigma_{1000}$ represents a magnetization (emu/g) of a carrier at 1,000 oersted, and Dc represents volume average particle diameter ($\mu$m) of the carrier.

The in-depth reason why the spent resistance of the carrier is improved is still unknown, but mechanism as follows may be considered. Toner is always surrounded by carrier particles. Accordingly, like in this invention, by reducing the magnetization of the carrier affecting the toner in the electric field by a developing sleeve, stress to toner particles sandwiched between carrier particles and the sleeve, or to toner particles sandwiched between carrier particles is reduced. Therefore, melting of the toner to the carrier surface is inevitably decreased, which may cause a sudden drop of the amount of toner spent.

Further, by making smaller the volume average particle diameter of the carrier, the same effect can also be obtained. That is, it is considered that by making smaller a particle diameter of a carrier, a magnetic flux that a carrier particle receives is decreased. Therefore, composite stress between the toner and the carrier is decreased. Further, it is found that the stability of triboelectric charge sharply increases by making larger a surface area of a carrier per unit weight and making the carrier hard to be affected by toner spent. Therefore, it is found that the carrier excellent in spent resistance can be obtained if the carrier is within the range of "$\sigma_{1000} \times Dc^3 \leqq 20{,}000{,}000$".

On the other hand, from the reverse reason, by reducing the magnetization of the carrier or making smaller the volume average particle diameter of the carrier, the composite stress between the toner and the carrier became weakened in the magnetic field of the developing sleeve. Therefore, the sufficient amount of triboelectric charge could not be obtained in a range of "$3{,}000{,}000 > \sigma_{1000} \times Dc^3$". Thus, background dirt or scattering of toner easily occurred.

As a result of studying by the inventors, it is found that the magnetic toner is harder to change to toner spent to the carrier as compared to the nonmagnetic toner even if their molecular weight distributions are equivalent to each other. There as on is as follows. The magnetic toner has magnetic powder exposed on its surface, and the exposed magnetic powder works as a spacer between the toner and the carrier, so that such an effect that the toner is hard to melt onto the carrier surface is recognized.

The toner having weight average particle diameter of 3 to 7 $\mu$m is preferable. If it exceeds 7 $\mu$m, a fine particle component effective in high image quality is decreased. If it is less than 3$\mu$m, powder fluidity as a toner gets worse. Further, toner particles of particle diameter 4 $\mu$m or less maybe contained at 10 to 70 number %, preferably 15 to 60 number % based on the total number of particles. If the toner particles having particle diameter of 4 $\mu$m or less are contained at less than 10 number %, the magnetic toner useful for high image quality is present in a small amount. Particularly, because the effective magnetic toner particle component is decreased as the toner is used by continuously copying or printing out, the image quality may gradually be degraded.

If the toner particles exceed 70 number %, agglomeration of the toner particles may easily occur and toner particles are easy changed to a toner cluster having particle diameter larger than the original one. Thereby, image quality may be degraded, and resolution is reduced, or a density difference between the edge part and the inside part of a latent image becomes large to easily become a void image. Thus, all the merits of improving image quality due to the toner of small particle diameter are eliminated.

It is preferable that particles of 8 $\mu$m or more are contained at 2.0 to 20.0 volume %, and a range of 3.0 to 18.0 volume % is more preferable. If the particles of 8 $\mu$m or more are contained at more than 20.0 volume %, the particles of larger particle diameter become too many, which causes image quality to be degraded. Further, as the particles have larger particle diameter, developing performance becomes higher. Therefore, development more than required, that is, too much toner is deposited, which causes increase in the amount of toner consumption. On the other hand, if such particles are contained at less than 2.0 volume %, fluidity is lowered no matter how the toner is treated, and image quality may be degraded.

In order to further improve the effect due to this invention, particles of 5.04 $\mu$m or less are contained at a range between 40 number % and 90 number %, preferably a range between 40 number % and 80 number % for the purpose of improving chargeability and fluidity of the toner.

Particles of 10.08 $\mu$m or more are contained at 6 volume % or less, preferably 4 volume % or less. If the particles of 10.08 $\mu$m or more exceed 6 volume %, a fine image cannot be obtained.

Although the particle size distribution of toner can be measured by various methods, in this invention, a Coulter counter was used for measurement. That is, a Coulter counter TA-II type (manufactured by Coulter Electronics Inc.) is used as a measuring device, to which an interface (manufactured by Nikkaki K.K.) for outputting number average distribution and volume distribution and a personal computer (manufactured by Ricoh Co., Ltd.) are connected. An electrolyte is obtained by adjusting 1% NaCl aqueous solution using primary sodium chloride.

The measuring method is executed as follows. A surface-active agent, preferably alkylbenzenesulfonate, of 0.1 to 5 ml as a dispersant is added into the electrolyte aqueous solution of 100 to 150 ml, and a measuring sample of 2 to 20 mg is added thereinto. The electrolyte in which the sample is suspended is subjected to dispersion for about 1 to 3 minutes by an ultrasonic dispersing device. The volume and number of toner particles are measured using a 100 $\mu$m aperture as an aperture by the Coulter counter TA-II type to compute a volume distribution and a number distribution of the toner particles of 2 to 40 $\mu$m. Weight average particle diameter (D4), (each median of channels was determined as a typical value for each channel) based on the weight reference obtained from the volume distribution according to this invention, was obtained. Further, the amount of coarse powder particles (≧16.0 μm) based on the weight reference obtained from the volume distribution, and the number of fine powder particles (≦5. 04 μm) based on the number reference obtained from the number distribution, each according to this invention, were then obtained.

As a carrier, it is preferable that the volume average particle diameter of a carrier is 15 to 45 μm. If the volume average particle diameter of a carrier is smaller than 15 μm, the value is too close to the average particle diameter of toner as a substance to which the amount of triboelectric charge is imparted, so that these two are hard to be mixed and stirred using the difference between their particle diameters. Accordingly, the sufficient amount of triboelectric charge cannot be provided to the toner, which causes background dirt to occur. Further, there is no allowance for carrier attraction. On the other hand, if the volume average particle diameter of the carrier exceeds 45 μm, basic image quality can be obtained, but adequate handling for higher image quality cannot be performed because higher density of a magnetic brush cannot be achieved.

Carrier particles smaller than 22 μm are contained at 1 to 20%, preferably 2 to 10%, and more preferably 2 to 6%. Further, carrier particles smaller than 16 μm are contained at 3% or less, preferably 1% or less, and more preferably 0.5% or less.

If the carrier particles of smaller than 22 μm exceed 20%, the fluidity of a developer increases beyond the appropriate range, which causes smooth triboelectricity to be spoiled. If the carrier particles smaller than 22 μm are less than 1%, the magnetic brush is not sufficiently magnetized, and rising of electrification of toner is worsened, which becomes causes of scattering of toner and background dirt.

If the carrier particles smaller than 16 μm exceed 3%, frequency of occurrence of carrier attraction becomes higher. When carrier attraction occurs, the carrier is adhered to the photoreceptor. Therefore, development by toner cannot be carried out on that part, and a void is produced on the image.

In this invention, it is preferable that carrier particles of 62 μm or more are contained at 2 to 15%. The carrier particles of 62 μm or more have an effect to improve fluidity of the entire developer. If such particles are contained at less than 2%, a uniform magnetic brush cannot be formed (the state of the magnetic brush becomes easily uneven). Resultantly, it is hard to obtain fine image quality. On the other hand, if carrier particles of 62 μm or more exceed 15%, larger-sized carrier particles increase overall, the density of the magnetic brush becomes smaller. Therefore, the allowance for reproducibility of fine lines is eliminated.

In this invention, it is preferable that carrier particles of 88 μm or more are contained at 2% or less. Although the basic image quality is not affected even if the carrier particles of 88 μm or more exceed 2%, the proportion of the carrier particles of 88 μm or more in the carrier is in substantially reverse proportional to the image quality. In this invention targeting high image quality, such carrier particles are controlled to be preferably within 2%.

As detriments occurring when respective particle diameter of the carrier and the toner is made smaller for improving image quality, fluidity of developer is lowered, and a developer in a developing device is hard to be circulated. For the countermeasures, the condition of the device maybe changed such that stirring strength in the developing device is enhanced. However, there may occur such a trouble that the durability of the developer is shortened, so that the change is not preferable. It is therefore important to keep a certain level of fluidity as a developer.

As means of keeping the fluidity of the developer, it is effective to control the shape of the carrier. That is, in this invention, the fluidity is improved by increasing the degree of sphericity of carrier particles.

Measurement of the particle size distribution of carrier in this invention was carried out by using an SRA type of Microtrac particle-size analyzer (manufactured by Nikkiso K.K.) as a measuring device and setting a value to a range of 0.7 to 125 μm. Further, by using SVR (manufactured by Nikkiso K.K.) as a sample circulator, a carrier sample having a high specific gravity could be measured with high precision.

This invention defines the shape of the carrier as follows.

The carrier is photographed by an SEM (scanning electron microscope) under an appropriate magnification. The length (X) and breadth (Y) of the carrier are measured. Such operation is performed on randomly at least 30 particles to obtain an average of Y/X. This invention is characterized in that the carrier has a shape whose ratio (Y/X) is within a range from 0.6 to 1.0 on the average.

Non-spherical carrier beyond this range has a problem that may occur in the fluidity of the developer and stirring efficiency as mentioned above. Therefore, such carrier is not preferable.

However, when the degree of sphericity is increased and the ratio Y/X is closed to 1, the cost is generally increased a lot even by controlling the processing condition such as sphericity performed through a spray dry method or thermal processing at a high temperature. After careful study, the inventors have found that even the carrier having reduced particle diameter can obtain sufficient performance if its diameter is within the range according to this invention.

In general, it is difficult to increase the sphericity as the particle diameter of the carrier is gradually reduced. In order to control the degree of sphericity like in the above case, control of manufacturing conditions, control of the viscosity of slurry when the spray dry method is used, for example, and temperature control are required. Further, an additive may be used. However, these conditions are not particularly limited, and it is possible to control the sphericity by controlling a sintering temperature in another method.

That is, the desirable fluidity of the developer in this invention is 25 to 55 (sec/50 g). If the fluidity is higher than 55 sec, the fluidity is not high enough, so that electrification cannot smoothly be imparted to the supplied toner, which causes image degradation. If the fluidity is lower than 25 sec, such a phenomenon that small particle clusters of developer are flowing can be seen. In such a state, the toner and the carrier are not sufficiently mixed and stirred, which causes scattering of toner and background dirt to occur.

Figure 2A:
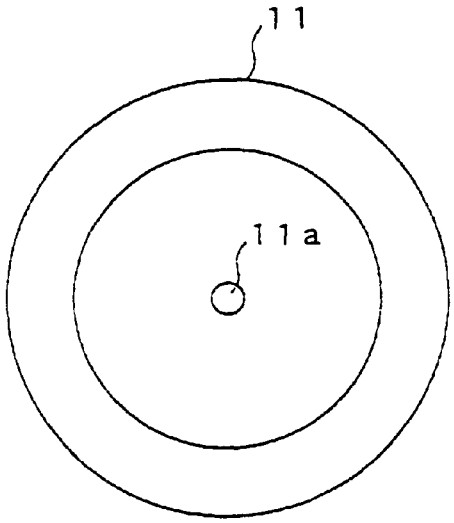
FIGS. 2A and 2B show a funnel forming the device of FIG. 1.
Figure 2B:
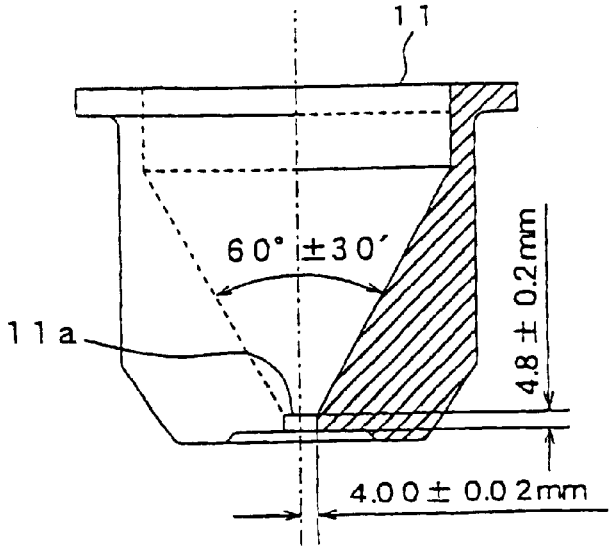

The fluidity of the developer in this invention is measured in the following manner. That is, the measurement is carried out by mixing the toner and the carrier, and leaving the mixture to stand for 24 hours under the environment at a temperature of 23° C.±2° C. and a humidity of 60% ±3%. The measuring method is based on JIS-Z2502. The measuring device is as shown in FIG. 1, but the funnel improved as shown in FIG. 2 is used. The fluidity measuring device (powder fluidity measuring unit) 1 in FIG. 1 comprises the funnel 11, a support arm 12 for supporting the funnel, a support bar 13 for supporting and fixing the support arm 12, fixing screws 14, and a support base 15. Legend 11*a* in FIG. 2 represents a sample outlet. This fluidity measuring device 1 is used for measuring a time (fluidity) required when a predetermined amount of powder is flown out from the sample outlet 11*a*.

Further, the data obtained when $\alpha$=0.4 in the following equation is used for measuring the fluidity of the developer.

$$\alpha=[Tc/(100-Tc)]\cdot(\rho_2/\rho_1)\cdot(r_2/4r_1)$$

Where Tc represents toner density (wt %); $\rho_1$ represents a true specific gravity of a toner; $\rho_2$ represents a true specific gravity of a magnetic carrier; $r_1$ represents weight average particle diameter ($\mu$m) of the toner; and $r_2$ represents volume average particle diameter ($\mu$m) of the magnetic carrier.

The carrier is affected by a magnet roller mounted in a developing sleeve because of its magnetic property. The affected carrier exerts a large effect on the developing property and conveyability of the developer. When the saturation magnetization to an applied magnetic field with 1000 oersted of the carrier is 40 to 120 emu/g, the uniformity of a copied image and gradation producibility become excellent, so that this range is most appropriate.

When the saturation magnetization exceeds 120 emu/g (to the applied magnetic field with 1000 oersted), a brush-like nap formed with the carrier and the toner on the developing sleeve, that is provided opposite to an electrostatic latent image on a photoreceptor, becomes hard and tightened at the time of developing. Therefore, reproduction of gradation and intermediate tones is degraded. If the saturation magnetization is less than 40 emu/g, it is difficult to hold the toner and carrier on the developing sleeve in their sufficient state, and such a problem that carrier adhesion or scattering of toner gets worse easily occurs. Further, when the residual magnetization and coercive force of the carrier are too high, adequate conveyability of the developer in the developing device is interfered. Resultantly, a blurred image or uneven density in a solid image as image defects easily occurs, which causes developing performance to be lowered.

Therefore, in order to maintain developing performance, it is important that the residual magnetization is 10 emu/g or less, preferably 5 emu/g or less, and more preferably zero in real terms. It is also important that the coercive force is 60 oersted or less (to the applied magnetic field with 3000 oersted), preferably 30 oersted or less, and more preferably 10 oersted or less.

In this invention, measurement of the magnetic properties of the carrier is performed as follows.

A BHU-60 type magnetization measuring device (manufactured by Riken Sokutei) is used as the measuring device. More specifically, a sample to be measured is weighed by about 1.0 g, a cell having an internal diameter of 7 mm and a height of 10 mm is filled with the sample, and the cell is set on the device. The measurement is carried out by changing the magnetization up to 3,000 oersted at maximum by gradually increasing the applied magnetic field. Subsequently, the applied magnetic field is getting decreased to finally obtain a hysteresis curve of the sample on recording paper. Accordingly, the saturation magnetization, residual magnetization, and a coercive force are determined.

Further, this invention includes at least titania particles as an external additive of toner, which is one of the characteristics of this invention. Particularly, anatase-type titania particles, which have been subjected to surface treatment while hydrolyzing a coupling agent in a water system, are extremely effective in stabilization of electrification and impartation of fluidity. These effects could not be achieved by generally known hydrophobic silica as a fluidity improving agent.

The reason is because the silica fine particle itself has strongly negative electrification but the titania fine particle has substantially neutral electrification. Conventionally, addition of the hydrophobic titania has been proposed. However, the titania particles have surface activity lower by nature than silica, so that hydrophobicity has not always been sufficiently performed. Further, when a large amount of treating agent was used or a high-viscosity treating agent was used, the hydrophobic degree was surely increased, but the particles were agglomerated and fluidity imparting capability was decreased. Therefore, both the stabilization of electrification and the impartation of fluidity could not necessarily be achieved.

On the other hand, the hydrophobic silica is surely excellent in the fluidity imparting capability, but if a large amount of such silica is contained in the toner, electrostatic agglomeration occurs in turn because of its strong electrification, and the fluidity imparting capability is decreased. On the contrary, the fluidity of toner is improved as the amount of titania is increased.

The method for using the anatase-type titania has been proposed in Japanese Patent Application Laid-Open No. 60-112052, for example. In this publication, the anatase-type titania has a small volume resistivity of $10^7$ ohm-cm. Therefore, if such anatase-type titania is used as it is, electrificationis rapidly leaked especially under high humidity, and it is not always satisfied in terms of stabilization of electrification, which needs improvement.

Further, a toner that contains titania processed by alkyltrialkoxysilane has been proposed in Japanese Patent Application Laid-Open No. 59-52255 as an example of containing hydrophobic titania in toner. The electrophotographic properties are surely improved through addition of the titania, but the surface activity of the titania is low by nature, therefore, particles are agglomerated in the processing stage, or hydrophobicity is nonuniform. Thus, the invention is not a satisfactory one.

The inventors have carefully studied in stabilization of electrification on toner, and have found the facts as follows. An anatase-type titania is subjected to treatment while a specific coupling agent is hydrolyzed in a water system, and has average particle diameter of 0.01 to 0.2 $\mu$m, a hydrophobic degree of 20 to 98%, and light transmittance in 400 nm of 40% or more. Such anatase-type titania can be subjected to uniform hydrophobicity imparting treatment without agglomeration of particles. Further, the toner that contains such titania is extremely effective in stabilization of electrification and impartation of fluidity.

That is, in this invention, the anatase-type titania particles are subjected to surface treatment while the particles are mechanically dispersed in a water system so that the particles become those having primary particle diameter and also the coupling agent is hydrolyzed in the water system. Resultantly, it is found that, as compared to the treatment in a vapor phase, agglomeration of particles does not easily occur. It is also found that the anatase-type titania particles in a state of almost primary particles are subjected to surface treatment through repulsive action by electrification between the particles due to the treatment.

One of the features of this invention is that the surface of titania is treated while hydrolyzing a coupling agent in a water system. In this case, mechanical force is applied on titania particles to be dispersed as primary particles. Therefore, it is not required to use a coupling agent having a feature of producing gas such as a chlorosilane group or silazane group. Further, a high-viscosity coupling agent, which could not be used so far because particles agglomerated in a vapor phase, can be used, so that hydrophobicity is extremely effective.

An effective method of methods for treating titania is to treat titania by hydrolyzing a coupling agent while the titania particles are mechanically dispersed in a water system so that the particles will become those having primary particle diameter. This method is preferable also at a point that a solvent is not used.

As a coupling agent used in this invention, any coupling agent such as a silane coupling agent or a titanium coupling agent may be used. The silane coupling agent may preferably be used. This agent is expressed in general formula as follows:

RmSiYn where R represents an alkoxyl group; m represents an integer of 1 to 3; Y represents a hydrocarbon group including an alkyl group, a vinyl group, a glycidoxy group, and a methacryl group; and n represents an integer of 1 to 3.

A concrete example of the silane coupling agent includes those as follows: vinyltrimethoxy silane, vinyltriethoxy silane, .gamma.-methacryloxypropyltrimethoxy silane, vinyltriacetoxy silane, methyltrimethoxy silane, methyltriethoxy silane, isobutyltrimethoxy silane, dimethyldimethoxy silane, dimethyldiethoxy silane, trimethylmethoxy silane, hydroxypropyltrimethoxy silane, phenyltrimethoxy silane, n-hexadecyltrimethoxy silane, and n-octadecyltrimethoxy silane, or the like.

The most preferable agent of these silane coupling agents is one expressed in general formula as follows:

$$C\alpha H2\alpha+1\text{-}Si(OC\beta H2\beta+1)3$$

where $\alpha$=4 to 12, $\beta$=1 to 3.

If $\alpha$ is smaller than 4 in the formula, treatment is performed easily, but hydrophobicity cannot be achieved sufficiently. If $\alpha$ is larger than 13, the sufficient degree of hydrophobicity can be achieved, but a large amount of titania particles agglomerates, which causes fluidity imparting capability to be lowered. Further, if $\beta$ is larger than 3, reaction is lowered so that hydrophobicity cannot be sufficiently performed. Therefore, in this invention, $\alpha$ is 4 to 12, preferably 4 to 8, and $\beta$ is 1 to 3, preferably 1 to 2.

The amount to be treated may be set to 1 to 50 wt.parts, preferably 3 to 40 wt.parts to 100 wt.parts of titania, and a hydrophobic degree may be 20 to 98%, preferably 30 to 90%, more preferably 40 to 80%.

That is, if the hydrophobic degree is smaller than 20%, the amount of electrification largely decreases due to being left for a long time under high humidity. Therefore, it is required to provide a mechanism for promoting electrification on the hardware side, so that a device becomes complicated. If the hydrophobic degree exceeds 98%, electrification control of titania itself becomes difficult even if the anatase-type titania having a small volume resistivity isused. Resultantly, toner is charged up under low humidity.

In this invention, as a method for measuring a hydrophobic degree of titanium oxide fine powder having a hydrophobic surface, a methanol measuring test explained below is used.

0.2 g of sample titanium oxide fine powder is added to 50 ml of water in a 250-ml conical flask. Methanol is dropped onto titanium oxide from a burette by titration until the entire titanium oxide is wetted. At this time, the solution in the flask is kept stirring with a magnetic stirrer all the time. The end point of this process is observed when the total amount of titanium oxide fine powder is suspended in the liquid. The hydrophobic degree is represented by a percentage of methanol in a liquid mixture of methanol and water when the suspension reaches the end point.

The particle diameter of the powder is preferably in a range of 0.01 to 0.2 $\mu$m in terms of fluidity impartation. If the particle diameter is larger than 0.2 $\mu$m, electrification on the toner becomes nonuniform due to insufficient fluidity. Resultantly, scattering of toner and background dirt may occur. If the particle diameter is smaller than 0.01 $\mu$m, the particles may easily be embedded in the surface of the toner, which causes the toner to be quickly deteriorated. Thus, the durability of the toner is in turn decreased. Such tendency is more significant in a low-temperature fixing toner (which indicates a low degree of hardness of toner surface) used in this invention. The particle diameter of titania in this invention was measured by FESEM.

Further, in this invention, treated titania has light transmittance in a 400-nm lightwave length of 40% or more, which is one of the features of this invention. That is, the titania used in this invention has extremely small primary particle diameter, which is 0.2 to 0.01 $\mu$m. However, when the titania is actually contained in the toner, the titania is not always dispersed as primary particles, but may exist as secondary particles. Therefore, if an effective diameter of the particle behaving as a secondary particle is large, the effect due to this invention is sharply decreased no matter how small the primary particle diameter may be.

Therefore, the higher light transmittance in 400 nm as a lower limit wavelength in the visible region a particle has, the smaller is the secondary particle diameter. Accordingly, successful results such as higher fluidity imparting capability and sharpness of a projected image of OHP in a case of color toner can be expected. The reason that 400 nm has been selected is because it is a boundary region between ultraviolet rays and visible rays. Further, ½ or less of a light wavelength passes through the particle, therefore, the transmittance of a wavelength longer than this wavelength becomes naturally higher, thus there is not much point to be tested.

The method of measuring light transmittance in this invention will be described below.

Sample 0.10 g

Alkyd resin 13.20 g (*1)

Melamine resin 3.30 g (*2)

Thinner 3.50 g (*3)

Glass media 50.00 g

*1 Beckosol 1323-60-EL, manufactured by Dainippon Ink and Chemicals, Inc.

*2 Super Beckomine J-820-60, manufactured by Dainippon Ink and Chemicals, Inc.

*3 Amylac thinner, manufactured by Kansai Paint K.K.

The mixture is collected in a 150-cc glass bottle, and is dispersed for one hour by a paint conditioner manufactured by Red Devil Co. After dispersion is finished, the mixture is applied to a PET film with a 2-mil doctor blade. This film is heated at 120° C. for 10 minutes, and baked. The transmittance is then measured in a range from 320 to 800 nm by U-BEST 50 manufactured by Nippon Bunko K. K., and compared.

Further, the crystal type of titania has been confirmed as the anatase type, by X-ray diffraction, in which a lattice constant (a) is 3.78 Å and a lattice constant (b) is 9.49 Å. On the other hand, as a method of obtaining hydrophobic titania having fine particle diameter, the following method is known. That is, volatile titanium alkoxide, etc. is oxidized at a low temperature, subjected to surface treatment after being subjected to sphericity to obtain spherical amorphous titania. However, considering that the materials to be used are costly and the manufacturing device is complicated, the present invention beats the above-mentioned method in terms of the cost. The titania of this invention is appropriated for satisfying developer fluidity and obtaining sufficient results.

By reducing particle diameter of toner, a surface area per weight increases, and excessive electrification due to friction is easily produced. In contrast, the effect of titania particles capable of controlling electrification and imparting fluidity to the toner is significant. A titania content adequate for this invention is 0.5 to 5 wt %, preferably 0.7 to 3 wt %, more preferably 1.0 to 2.5 wt %.

An electrification controlling agent for stabilizing electrification may be mixed with the toner according to this invention. As the electrification controlling agent, any well-known polarity controlling agent such as Nigrosine dye, metal complex dye, or quaternary ammonium salt can be used singly or mixedly. In this case, a colorless or light-colored charge controlling agent, which exerts no effect on gradations in color of the toner is desirable. A negative charge controlling agent at this time includes organic metal complex salt like metal complex salt of alkyl substituted salicylic acid (e.g., chrome complex salt of di-tert-butyl salicylic acid or zinc complex salt or zirconium compound complex salt). When the negative charge controlling agent is combined with a toner, the agent may be added to the toner by 0.1 to 10 wt.parts, preferably 0.5 to 8 wt.parts to a binder resin of 100 wt.parts.

When a mixture ratio between the toner and the carrier according to this invention is in a range from 2 to 30 wt %, preferably 3 to 9 wt % as a toner concentration in a developer, a successful result can generally be obtained. If the toner concentration is less than 2 wt %, image density is low, which is not practical. If the toner concentration exceeds 30 wt %, background dirt and scattering of toner in a device increase even if it is a magnetic toner, so that the durability of the developer is reduced.

As a colorant, any of the well known dyeing pigments as follows can be used singly or mixedly, and can be also used as either black toner or full-color toner. That is, carbon black, lamp black, black iron oxide, Aniline Blue, Phthalocyanine Blue, Phthalocyanine Green, Hansa Yellow G, Rhodamine 6C lake, Chalco Oil Blue, Chrome Yellow, Qunacridone, Benzidine Yellow, Rose Bengal, triallylmethane-base dye, etc. The amount to be used of these colorants is generally 1 to 30 wt %, preferably 3 to 20 wt % to a toner resin component.

An additive may be mixed with the toner of this invention as required within a range in which properties of the toner will not be spoiled. The additive includes a lubricant as Teflon or zinc stearate, a fixing assistant (e.g., low-molecular-weight polyethylene, low-molecular-weight polypropylene), or organic resin particles.

As magnetic particles to be used in this invention, any of known ones is available, and is preferably 5 to 35 wt %. If less than 5 wt %, magnetic particles do not function as magnetic toner, therefore, background dirt can not be improved. On the other hand, if exceeding 35 wt %, developing performance adequate as toner will be eliminated.

Further, the toner of this invention can be used by being mixed with any of the well known releasing agents as follows: carnauba wax, montan wax, oxidized rice wax, solid silicone vanish, higher fatty acid higher alcohol, and low-molecular-weight polypropylene wax, etc. The amount to be used of any of these releasing agents is 1 to 20 wt.parts, preferably 3 to 10 wt.parts to a toner resin component. Free fatty acid freed carnauba wax is particularly preferable. As the carnauba wax, fine crystal having an acid value of 5 or less is preferred. Further, its particle diameter of 1 $\mu$m or less when the particles are dispersed into toner binder is preferable. The amount to be added to the toner may be 1 to 20 wt %, more preferably 3 to 10 wt %.

For production of the toner of this invention, various methods as follows are applicable: a) a method for obtaining the toner through mechanical grinding and classification after kneading well component materials by a heat kneading machine such as a heat roller, a kneader, or an extruder; b) a method for obtaining the toner by dispersing a material of colorant or the like into solution of a binder resin, spraying and drying it; c) a method for manufacturing polymerized toner to obtain the toner by mixing a predetermined material with a monomer forming a binder resin, and polymerizing this emulsion suspension.

As a binding substance to be used for the toner of this invention, any type of material resin conventionally known as electrophotographic toner binder resin can be used if it satisfies the molecular weight of the toner according to this invention. For example, polystyrene and a styrene base copolymer such as a styrene-butadiene copolymer or a styrene-acrylic copolymer; polyethylene and an ethylene base copolymer such as an ethylene-vinyl acetate copolymer or an ethylene-vinyl alcohol copolymer; phenol resin, epoxy resin, acrylphthalate resin, polyamide resin, polyester resin, or maleic-based resin. However, the manufacturing method for any of these resins may not particularly be restricted.

Of these resins, especially, when any of polyester-based resins having high negative charging capacity is used, the effect due to this invention will be significant. That is, the polyester resin is excellent in fixability, but has high negative charging capacity, so that electrification is easy to become too high. However, when this polyester resin is used for the components of this invention, the detriment is improved, thus obtaining excellent toner.

The polyester resin used in this invention is obtained through condensation polymerization of alcohol and carboxylic acid. An alcohol to be used is as follows: a glycol group such as ethylene glycol, diethylene glycol, triethylene glycol, and propylene glycol; an etherified bisphenol group such as 1.4-bis (hydroxymethyl) cyclohexane and bisphenol A; a dihydric alcohol monomer, and a tri- or a polyhydric alcohol monomer. The carboxylic acid includes: a divalent organic acid monomer such as maleic acid, fumaric acid, phthalic acid, isophthalic acid, terephthalic acid, syccinic acid, or malonic acid; and a tri- or a polyvalent carboxylic acid monomer such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxy propane, and 1,2,7,8-octanetetracarboxylic acid, etc. A grass transition temperature Tg of the polyester resin is preferably 55° C. or higher in terms of heat preservability, more preferably 60° C. or higher.

In particular, when polyester resin particles having high negative charging capacity are used as a toner material, a copolymer with a styrene base monomer is preferable for stabilizing electrification. Further, it is preferable that the weight percentage of copolymerization of the styrene base monomer is 5 to 70 wt %.

As a carrier used for the developer of this invention, any carrier coated with resin is preferred. An electrically insulating resin is used as resin for coating the surface of carrier, but the resin is selected as required according to the toner material or carrier core material. In this invention, in order to improve adhesion to the surface of the carrier core material, it is desirable that the carrier contains a silicone resin or a siloxane composite material, but it is not particularly restricted.

As the core material of the carrier used in this invention, any of those as follows can be used: metal such as iron whose surface is oxidized or unoxidized, nickel, cobalt, mangane, chrome, or a rare earth element; an alloy or an oxide of any of the metal; and a magnetic substance-dispersed resin particles, or the like. However, a metal oxide is preferably used, and ferrite particles are more preferably used. The method of manufacturing these particles is not particularly restricted.

When the average particle diameter of the carrier is less than 10 $\mu$m, the carrier is easily developed (developed with the toner) on a latent image holding body, which makes it easy to give damages to the latent image holding body and a cleaning blade. Even if it is less than 15 $\mu$m, the similar damages also tend to occur depending on the difference of developing conditions. On the other hand, if the average particle diameter of the carrier is larger than 45 $\mu$m, the toner holding capacity of the carrier is particularly decreased in the combination with small-diameter toner of this invention. Accordingly, unevenness of a solid image, scattering of toner, and background dirt or the like easily occur. Such a carrier core material may be formed only with a magnetic material, or may be formed with a combination of the magnetic material and a nonmagnetic material or with a mixture of at least two types of magnetic particles.

As the method for coating the surface of the carrier core material with the coating resin, the method as follows is preferable. That is, the method for resolving or suspending the resin in a solvent, applying the solvent onto the surface of the core material to deposit the resin to the core material formed with the magnetic particles or the like. However, any other method, like a dry application method without using a solvent, may be used, and the method is not particularly restricted. The amount to be treated of the coating resin is desirably 0.1 to 30 wt % (preferably 0.5 to 20 wt %) to the carrier core material based on its total amount in terms of film forming capacity and durability of the coating material.

The image formation apparatus with the built-in container filled with the two-component developer according to this invention will be explained below.

Figure 3:
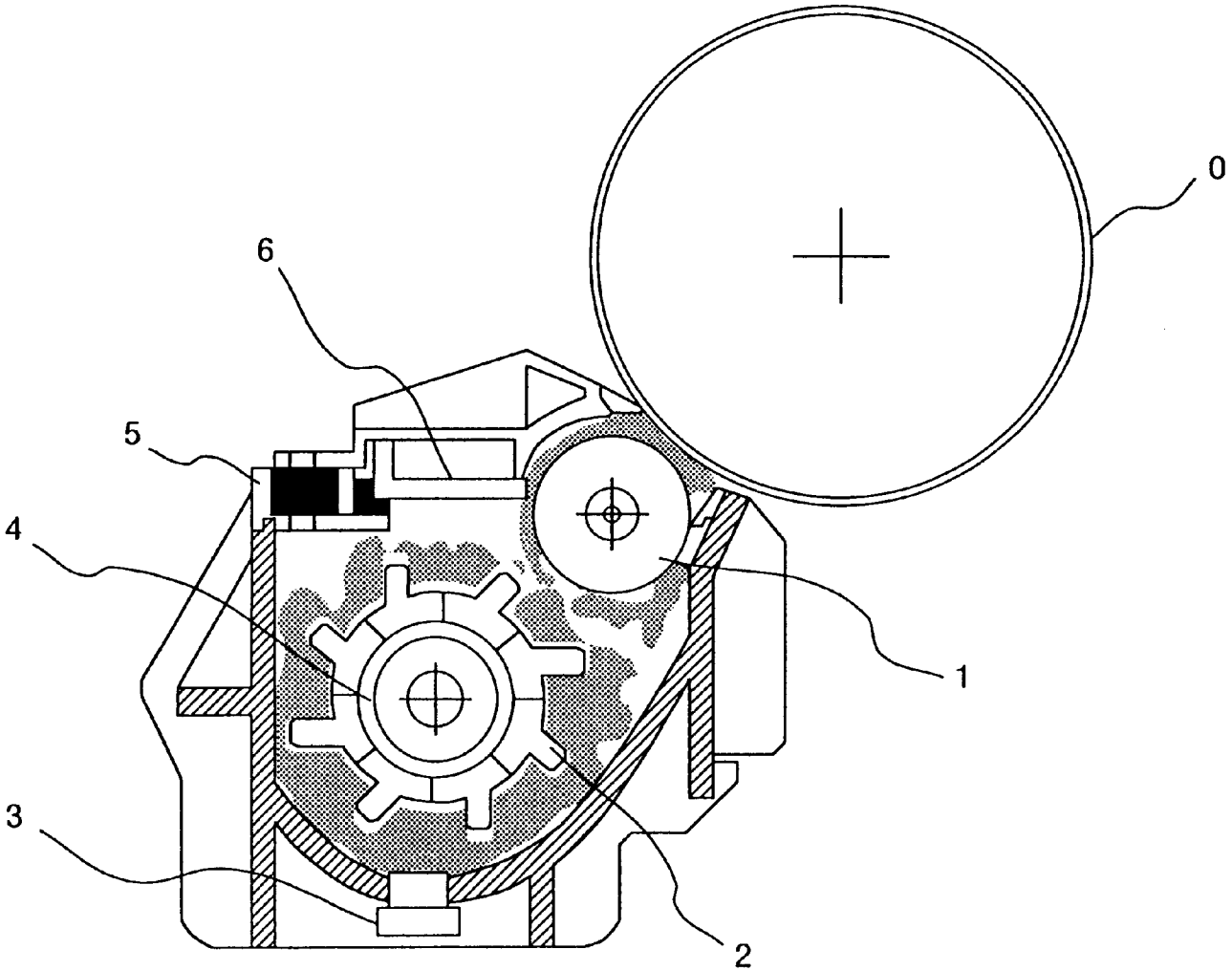
FIG. 3 shows the image formation apparatus according to this invention as an example.

FIG. 3 shows the image formation apparatus according to this invention as an example. The image formation apparatus of this invention will be explained with reference to FIG. 3. In FIG. 3, the apparatus is divided broadly into two parts. One of the parts is a photoreceptor 0, and the other is a developing device provided with components 1 to 6. The internal side of this developing device contains the two-component developer of this invention. The paddle 2 rotates in the clockwise direction, and has a function of making carrier sufficiently electrify toner due to friction by stirring and mixing the two-component developer existing the internal side and periphery of the paddle 2. Further, the paddle 2 has a function of sucking the two-component developer having the toner sufficiently electrified by friction up to the developing sleeve 1. As mentioned above, the developing sleeve 1 rotates in the clockwise direction, and conveys the two-component developer to a developing area in synchronism with its movement. The two-component developer conveyed to the developing area develops the toner on the photoreceptor 0 based on image information on the photoreceptor 0. Further, the two-component developer passing through the developing area by rotation of the developing sleeve 1 is returned again into the developing device. The doctor blade 6 is provided for controlling the layer thickness of the two-component developer, that has been sucked onto the developing sleeve by the paddle 2, to a constant level. The T sensor 3 is used for controlling the amount of toner in the two-component developer though it is not necessary in this invention. The conveying screw 4 is used for conveying the two-component developer inside of the paddle 2 in the longitudinal direction. The depressurizing filter 5 is provided for eliminating an air difference between the inner and outer sides of the developing device.

EXAMPLES

The image formation apparatus will be explained in detail below with reference to Examples.

TABLE 1

| Polyester resin | Non-linear resin (A) | Linear resin (B) | Tm (A)-Tm (B) |
|---|---|---|---|
| Acid values (AV) mgKOH/g | 27.1 | 9.5 | |
| Softening point (Tm) ° C. | 147.2 | 100.2 | 47 |
| Glass transition point (Tg) ° C. | 60.4 | 62.4 | |
| THF insoluble portion % | 27.1 | 0 | |

| Production of Toner A | |
|---|---|
| Polyester resin (A) | 60 parts |
| Polyester resin (B) | 40 parts |
| Hydrogenated petroleum resin: (hydrogenation: 90%, composition: dicyclopentadiene + aromatic system) | 15 parts |
| Carnauba wax (melting point: 82° C., acid value: 2) | 3 parts |
| Carbon black (#44, manufactured by Mitsubishi Kasei Corp.): | 8 parts |
| Chrome-containing monoazo complex: | 3 parts |

The toner having weight average particle diameter of 8.0 $\mu$m was obtained by sufficiently stirring and mixing the mixture of the above-mentioned composition in a Henshell mixer, heating and melting it at 130 to 140° C. for about 30 minutes by a roll mill, cooling it down to a room temperature to grind and classify the obtained mixture by a jet mill. The number average molecular weight (Mn) of this toner was 2,600, and the proportion of molecules having a molecular weight of 1,000 or less was 43 number %. Further, an additive of 0.5 part (R972: manufactured by Nippon Aerosil Co., Let.) was added to the toner of 100 parts, stirred and mixed by the Henshell mixer, and particles of large particle diameter were removed through a mesh to obtain final toner.

| Production of Carrier | |
|---|---|
| Core material: | 5000 parts |
| Silicone resin (SR2410, manufactured by Toray Dow Corning Silicone Co., Nonvolatile part: 23%): | 450 parts |
| .gamma. - (2-aminoethyl) aminopropyltrimetoxy silane: (SH6020, manufactured by Toray Dow Corning Silicone Co.) | 9 parts |
| Conductive carbon black: (Black Perls 2000, manufactured by CABOT) | 11 parts |
| Toluene: | 450 parts |

The coating device explained below was used for applying a coating agent onto the carrier core material. That is, this coating device rotates a rotary bottom plate disk in a fluidized bed at a high speed and performs coating while forming a whirling flow. The obtained carrier was heated in an electric furnace at a temperature of 300° C. for one hour to obtain the carrier.

Example 1

Coating and hardening were performed in the above manner using Cu—Zn base ferrite particles to obtain carrier 1 for Example 1. The carrier 1 of 96 parts was mixed with the toner A of 4 parts to obtain a two-component developer. This two-component developer was set on a developing section of Imagio MF4570 Improved machine manufactured by Ricoh Co., Ltd. (a fixing temperature was set to a value lower by 20° C. than usual). Durability test was executed up to 100,000 sheets, and the amount of toner spent and the amount of triboelectric charge at that time were measured. The results of the measurement are represented in Table 2. During the durability test for 100,000 sheets, even one copy insufficiently fixed did not occur although the fixing temperature was set to the lower value.

Example 2

Coating and hardening were performed in the above manner using magnetite particles to obtain carrier 2 for Example 2. The carrier 2 of 95 parts was mixed with the toner A of 5 parts to obtain a two-component developer. This two-component developer was set on the developing section of Imagio MF4570 Improved machine manufactured by Ricoh Co., Ltd. Durability test was executed up to 100,000 sheets, and the amount of toner spent and the amount of triboelectric charge at that time were measured. The results of the measurement are represented in Table 2. The results are found superior to these in Example 1 in terms of definition of image quality.

Comparative Example 1

Coating and hardening were performed in the above manner using Cu—Zn base ferrite particles to obtain carrier 3 for Comparative Example 1. The carrier 3 of 97 parts was mixed with the toner A of 3 parts to obtain a two-component developer. This two-component developer was set on the developing section of Imagio MF4570 Improved machine manufactured by Ricoh Co., Ltd. Durability test was executed up to 100,000 sheets, and the amount of toner spent and the amount of triboelectric charge at that time were measured. The results of the measurement are represented in Table 2. Background dirt was found worse, so that definition of the image could not be evaluated.

Respective particle size distributions of the carriers 1 to 3 are represented in Table 3.

TABLE 3

| Carrier | | 1 | 2 | 3 |
|---|---|---|---|---|
| Particle size distribution | Average particle diameter (μm) | 65 | 50 | 80 |
| | +88 μm (%) | 23.3 | 10.6 | 39.4 |
| | +62 μm (%) | 55.6 | 31.5 | 63.2 |
| | −22 μm (%) | 0 | 4.7 | 0 |
| | −16 μm (%) | 0 | 3.3 | 0 |

* The amount of toner spent: The developer after the durability test for 100,000 copies was finished was blown off to remove only the toner, and the obtained carrier was cleaned by MEK. The MEK cleaning solution was heated, and the weight of the obtained solid portion was measured. The measured value was determined as toner spent weight, and was represented by wt % to the entire amount of the carrier.
* The ranking of background dirt: The background dirt was ranked on a scale of 1 to 5, and the dirt was visually determined according to the evaluation rank as explained below. Rank 5 is the highest. Rank 3.5 represents an allowable level. The rank 3.5 mentioned here represents the dirt regarded as the level between rank 3 and rank 4 as a result of visually checking, and this level is substantially successful.

(5) No background dirt is found
(4) Level at which background dirt cannot be recognized unless it is carefully checked
(3) Level at which background dirt can be partially recognized
(2) Level at which background dirt appears slightly over the image
(1) Level at which background dirt appears clearly over the image Example 3

| | |
|---|---|
| Polyester resin (B) | 80 parts |
| Stylenemethylacrylate: | 20 parts |
| Magnetite particles: | 30 parts (21.3 wt %) |
| Carbon black (number average 0.05 μm): | 5 parts |
| Low-molecular-weight polypropylene: | 5 parts |
| Metal-containing azo compound: | 1 part |

Such components were previously mixed properly by the Henshell mixer, and melted and kneaded by a double-axis extruder. After being cooled, the components were coarsely ground into about 1 to 2 mm using a hammermill and finely ground by an air-jet type of pulverizer. The obtained finely ground substance were classified by a multidivision classifying device, particles of 2 to 8 μm were selected so as to

TABLE 2

| | Magnetization | Particle diameters | | Toner | Triboelectric charge amount | | Image quality |
|---|---|---|---|---|---|---|---|
| | $\sigma_{1000}$ (emu/g) | Dc (μm) | $\sigma_{1000} \times Dc^3$ | spent (wt %) | START (μC/g) | 100,000 copies (μC/g) | Background dirt ranking |
| EXAMPLE 1 | 60 | 65 | 16,477,500 | 0.22 | −29.1 | −26.5 | 4 |
| EXAMPLE 2 | 82 | 50 | 10,250,000 | 0.10 | −28.7 | −31.3 | 5 |
| COMPARATIVE EXAMPLE 1 | 60 | 80 | 30,720,000 | 0.43 | −27.9 | −15.2 | 2 |

become the particle size distribution of this invention, and magnetic colorant-containing resin particles were obtained. The number average molecular weight (Mn) of this toner was 2,400, and the proportion of the molecules having a molecular weight of 1,000 or less was 53 number %.

While mixing hydrophilic anatase-type titania particles (particle diameter: 0.05 μm, BET: 120 $m^2/g$) with the particles and stirring it in a water system, n-$C_4H_9$—$S_i$ $(OCH_3)_3$ was dispersed in the water system and was added to and mixed with the titania particles while being hydrolyzed so that the solid portion of n-$C_4H_9$—$S_i$ $(OCH_3)_3$ would be 20 wt % to the titania particles and the particles would not be agglomerated. The titania 1.5%, having hydrophobic degree of 70%, average particle diameter of 0.05 μm, transmittance in 400 nm of 60% obtained by being dried and ground, was mixed to form toner B.

This toner B had the properties as follows. The weight average particle diameter: 5.90 μm, particles having particle diameter of 4μm or less: 16.8 number %, particles having particle diameter of 5.04 μm or less: 46.2 number %, particles having particle diameter of 8 μm or more: 6.6 volume %, and particles having particle diameter of 10.08 μm or more: 1.0 volume %.

The carrier <A> in [TABLE 4] explained below was mixed to the toner B of 7 parts so that the total amount would be 100 parts to form a developer. This carrier <A> was carrier coated with a coating material, which consisted of 450-part SR2410 and 5-part SH6020, by about 1 wt %, as shown in [TABLE 5] explained below. [TABLE 4] shows respective particle size distributions of carriers B to H, in addition to the carrier <A>, used in Examples 3 to 10 and Comparative Examples 2 to 4 explained later, and compositions of a ferrite core agent. [TABLE 5] also shows magnetic properties of the carriers and carrier shapes, respectively. In [TABLE 4], for example, "+88 μm (%)" represents a content of carrier particles having particle diameter of 88 μm or more, and "−22 μm (%)" represents a content of carrier particles having particle diameter of less than 22 μm.

TABLE 4

| Carrier | | A | B | C | D | E | F | G | H |
|---|---|---|---|---|---|---|---|---|---|
| Ferrite core material composition | | | | | Mn—Mg | | | | Li—Mg—Ca |
| Particle size distribution | Average particle diameter (μm) | 40.3 | 42.9 | 38.5 | 28.9 | 40.8 | 41.6 | 40.6 | 39.3 |
| | +88 μm (%) | 1.4 | 0.8 | 0.3 | 0.3 | 1.2 | 1.1 | 0.9 | 1.1 |
| | +62 μm (%) | 9.9 | 10.1 | 1.0 | 7.2 | 9.8 | 10.3 | 9.4 | 9.2 |
| | −62 μm (%) | 8.2 | 8.6 | 8.8 | 12.9 | 8.3 | 8.4 | 17.8 | 8.6 |
| | −16 μm (%) | 0.3 | 0.2 | 0.0 | 0.9 | 0.2 | 0.2 | 5.0 | 0.2 |

TABLE 5

| Carrier | | A | B | C | D | E | F | G | H |
|---|---|---|---|---|---|---|---|---|---|
| Magnetic properties | Saturation magnetization | 68 | 68 | 67 | 66 | 68 | 68 | 67 | 38 |
| | Residual magnetization | 0 | 0 | 0 | 0 | 0 | 0 | 0 | 0 |
| | Coercive force (Oersted) | 0 | 0 | 0 | 0 | 0 | 0 | 0 | 0 |
| Coating material | | | | SR2410:SH6020 = 450:5 | | | | | |
| Shape | Y/X | 0.82 | 0.90 | 0.84 | 0.69 | 0.49 | 0.46 | 0.86 | 0.85 |

Using the developer, test was carried out under the environment at temperature/humidity of 23° C./60% (developing condition: developing bias-600 v) by using a Copier MF-200 improved machine manufactured by Ricoh Co., Ltd. (1. The screw shape of the developing device is partially improved. 2. A five-pole-structured magnet roller having a developing mainpole of 960 gauss ($0.96\times10^5$ μT) is built in the developing sleeve. 3. A fixing temperature is set to a value lower by 30° C. than usual). As a result, images superb in image definition even after printing-resistant tests for 10,000 copies and whose image density is 1.5 to 1.6 could be obtained with stability, and developer concentration was well controlled and stabilized. Further, the images were output in the same manner under the conditions of 23° C./5% and 23° C./80%, and the excellent result was obtained. Regarding the image quality, higher definition of image quality than that of Example 2 was obtained. Further, even one copy insufficiently fixed did not occur in the image-outputting test.

Example 4

Images were output in the same manner as Example 3 except using the carrier <B>, whose core material only was changed, instead of the carrier <A> in Example 3. The successful result was then obtained.

Example 5

Images were output in the same manner as Example 3 except using the carrier <C>, whose core material only was changed, instead of the carrier <A> in Example 3. The excellent result was then obtained although the image obtained after 10,000-copy duplication was of slightly inferior image definition as compared to that of Examples 3 and 4.

Example 6

Images were output in the same manner as Example 3 except the conditions as follows, and the excellent result was obtained. That is, except using, instead of carbon black in Example 3, toner using a phtalocyanine pigment (Toner C, where weight average particle diameter: 6.11 μm, particles having particle diameter of 4 μm or less: 25.0 number %, particles having particle diameter of 5.04 μm or less: 53.1 number %, particles having particle diameter of 8 μm or more: 10.7 volume %, and particles having particle diameter of 10.08 μm or more: 1.4 volume %), and the carrier <B> in [TABLE 4].

Example 7

Toner (Toner D) was obtained in the same manner as Example 3 except using the titania particles (hydrophobic degree: 65%, average particle diameter: 0.05 μm, and transmittance in 400 nm: 65%) using iso-$C_4H_9$—$S_i$ $(OCH_3)_3$ by 25 wt %. The images were output in the same manner as Example 3 by combining the toner D with the carrier <B> in [TABLE 4], and the excellent result was obtained.

Comparative Example 2

Images were output in the same manner as Example 3 except using the carrier <D> in [TABLE 4] instead of the carrier <A>. As a result, the background dirt became significant in 10,000-copy duplication, which was regarded as No Good. The amount of electrification on the developer at that point in time was measured, and it was found that there was a large amount of reversely charged toner. However, the amount of triboelectric charge was small.

Example 8

Images were output in the same manner as Example 3 except using the carrier <E> in [TABLE 4] instead of the carrier <A>. The substantially positive result was then obtained although it was found that the image density after 10,000-copy duplication lowered by about 0.1 in addition to occurrence of slightly uneven image density.

Example 9

Images were output in the same manner as Example 3 except using the carrier <F> in [TABLE 4] instead of the carrier <A>. Sufficient images were obtained in the initial stage, and not particular problem was found except the fact that the image density after 10,000-copy printing lowered by about 0.2.

Comparative Example 3

Images were output in the same manner as Example 3 except the point that the titania was not used in Example 3. As a result, the background dirt was worse and toner was scattered under the conditions of 23° C./60%.

Example 10

Images were output in the same manner as Example 3 except using the carrier <G> in [TABLE 4] instead of the carrier <A>. As a result, the image definition was in the same level as that of Example 3, and not particular problem was found except the fact that slight carrier attraction occurred when a specific document (the document with which carrier attraction may easily occur) was used.

Comparative Example 4

Images were output in the same manner as Example 3 except using the carrier <H> in [TABLE 4] instead of the carrier <A>. As a result, the image definition was in the same level as that of Example 3 in the initial stage. However, much of the carrier attraction occurred, so that many void parts were seen on the image. Further, the background dirt became significant in 10,000-copy duplication, so the images were regarded as No Good. The amount of electrification on the developer at that point in time was measured, and it was found that there was a large amount of reversely charged toner. However, the amount of triboelectric charge was small.

TABLE 6

| | Developer fluidity (sec/50 g) | Magnetization $\sigma_{1000}$ (emu/g) | Particle Diameters DC (μm) | $\sigma_{1000} \times DC^3$ | Toner spent (wt %) | Triboelectric charge amount START (μC/g) | Triboelectric charge amount 100,000 copies (μC/g) | Image quality Background dirt ranking |
|---|---|---|---|---|---|---|---|---|
| Example 3 | 42.1 | 68 | 40.3 | 4,464,254 | 0.20 | 40.1 | 32.1 | 4 |
| Example 4 | 32.2 | 68 | 42.9 | 5,383,876 | 0.23 | 43.3 | 33.3 | 4.5 |
| Example 5 | 52.4 | 67 | 38.5 | 3,833,304 | 0.17 | 39.6 | 32.9 | 4 |
| Example 6 | 34.5 | 68 | 42.9 | 5,383,876 | 0.24 | 45.4 | 34.5 | 4.5 |
| Example 7 | 31.9 | 68 | 42.9 | 5,383,876 | 0.23 | 44.2 | 34.0 | 5 |
| Comparative example 2 | 56.0 | 66 | 28.9 | 1,597,714 | 0.07 | 27.8 | 20.0 | 2 |
| Example 8 | 66.4 | 68 | 40.8 | 4,616,001 | 0.21 | 38.7 | 28.9 | 3.5 |
| Example 9 | 71.0 | 68 | 41.6 | 4,889,762 | 0.22 | 39.0 | 27.8 | 3.5 |
| Comparative example 3 | Not flown out | 68 | 40.3 | 4,464,254 | 0.40 | 19.5 | 11.7 | 1 |
| Example 10 | 48.7 | 67 | 40.6 | 4,472,944 | 0.20 | 41.9 | 33.5 | 4 |
| Comparative example 4 | 49.9 | 38 | 39.3 | 2,310,770 | 0.10 | 28.5 | 21.4 | 2 |

As clearly understood from the above detailed and specific explanation, the two-component developer according to this invention uses the low-temperature fixing toner, in which toner spent onto the surface of the carrier hardly occurs, and triboelectricity is stabilized with a sufficient amount of triboelectric charge.

The present document incorporates by reference the entire contents of Japanese priority documents, 2000-151041 filed in Japan on May 23, 2000, and 2000-239220 filed in Japan on Aug. 7, 2000.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A two-component developer consisting of a toner, which contains at least a resin and a colorant and to which an external additive is added, and a carrier;

wherein a number average molecular weight of said toner is 3,000 or less; wherein molecules having a molecular weight of 1,000 or less are contained at 40 number % or more, and wherein said carrier satisfies general formula (1) as follows:

$$3{,}000{,}000 \leqq \sigma_{1000} \times Dc^3 \leqq 20{,}000{,}000 \quad (1)$$

wherein $\sigma_{1000}$ represents a magnetization in emu/g of a carrier at 1,000 oersted; and wherein Dc represents a volume average particle diameter in $\mu$m of said carrier;

wherein the volume average particle diameter of said carrier is not larger than 65 $\mu$m.

2. The two-component developer according to claim 1, wherein said toner is a magnetic toner, which has weight average particle diameter of 3 to 7 $\mu$m, and contains toner having a particle diameter of 5.04 $\mu$m or less at more than 40 number %, toner having a particle diameter of 4 $\mu$m or less at 10–70 number %, toner having a particle diameter of 8 $\mu$m or more at 2 to 20 volume %, and toner having a particle diameter of 10.08 $\mu$m or more at 6 volume % or less.

3. The two-component developer according to claim 1, wherein said carrier has a volume average particle diameter of 15 to 45 $\mu$m, and contains carrier particles smaller than 22 $\mu$m at 1 to 20%, carrier particles smaller than 16 $\mu$m at 3% or less, carrier particles of 62 $\mu$m or more at 2 to 15%, and carrier particles of 88 $\mu$m or more at 2% or less.

4. The two-component developer according to claim 1, wherein a saturation magnetization of said carrier to an applied magnetic field of 1,000 oersted is 40 to 120 emu/g, a residual magnetization is not more than 10 emu/g, and a coercive force is not more than 60 oersted.

5. The two-component developer according to claim 1, wherein a fluidity of said developer is 25 to 55 sec/50 g.

6. The two-component developer according to claim 1, wherein said external additive is titania particles having an average particle diameter of 0.01 to 0.2 $\mu$m, a hydrophobic degree of 20 to 98%, and a light transmittance at 400 nm of not less than 40%.

7. The two-component developer according to claim 1, wherein said carrier has such a shape that an average ratio between its length and breadth is in a range from 0.6 to 1.0 when said carrier is regarded as a plane image.

8. An image formation apparatus with the built-in container filled with a two-component developer consisting of a toner, which contains at least a resin and a colorant and to which an external additive is added, and a carrier, wherein a number average molecular weight of said toner is 3,000 or less; wherein molecules having a molecular weight of 1,000 or less are contained at 40 number % or more; and wherein said carrier satisfies general formula (1) as follows:

$$3{,}000{,}000 \leqq \sigma_{1000} \times Dc^3 \leqq 20{,}000{,}000 \quad (1)$$

wherein $\sigma_{1000}$ represents a magnetization in emu/g of a carrier at 1,000 oersted; and wherein Dc represents a volume average particle diameter in $\mu$m of said carrier.

9. The image formation apparatus according to claim 8, wherein the volume average particle diameter of said carrier is not larger than 60 $\mu$m.

10. The image formation apparatus of calim 8, wherein said toner is a magnetic toner, which has weight average particle diameter of 3 to 7 $\mu$m, and contains toner having a particle diameter of 5.04 $\mu$m or less at more than 40 number %, toner having a particle diameter of 4 $\mu$m or less at 10–70 number %, toner having a particle diameter of 8 $\mu$m or more at 2 to 20 volume %, and toner having a particle diameter of 10.08 $\mu$m or more at 6 volume % or less.

11. The image formation apparatus according to claim 8, wherein said carrier has a volume average particle diameter of 15 to 45 $\mu$m, and contains carrier particles smaller than 22 $\mu$m at 1 to 20%, carrier particles smaller than 16 $\mu$m at 3% or less, carrier particles of 62 $\mu$m or more at 2 to 15%, and carrier particles of 88 $\mu$m or more at 2 % or less.

12. The image formation apparatus according to claim 8, wherein a saturation magnetization of said carrier to an applied magnetic field of 1,000 oersted is 40 to 120 emu/g, a residual magnetization is not more than 10 emu/g, and a coercive force is not more than 60 oersted.

13. The image formation apparatus according to claim 8, wherein a fluidity of said developer is 25 to 55 sec/50 g.

14. The image formation apparatus according to claim 8, wherein said external additive is titania particles having an average particle diameter of 0.01 to 0.2 $\mu$m, a hydrophobic degree of 20 to 98%, and a light transmittance at 400 nm of not less than 40%.

15. The image formation apparatus according to claim 8, wherein said carrier has such a shape that an average ratio between its length and breadth is in a range from 0.6 to 1.0 when said carrier is regarded as a plane image.

16. The two-component developer according to claim 1, wherein said toner is a magnetic toner.

17. The two-component developer according to claim 1, wherein said carrier is a magnetic carrier.

18. The two-component developer according to claim 1, wherein said magnetization is a saturation magnetization.

19. A two-component developer consisting of a toner, which contains at least a resin and a colorant and to which an external additive is added, and a carrier;

wherein a number average molecular weight of said toner is 3,000 or less; wherein molecules having a molecular weight of 1,000 or less are contained at 40 number % or more; and wherein said carrier satisfies formula (1) as follows:

$$3{,}000{,}000 \leqq \sigma_{1000} \times Dc^3 \leqq 20{,}000{,}000 \quad (1)$$

wherein $\sigma_{1000}$ represents a magnetization in emu/g of the carrier at 1,000 oersted; and wherein Dc represents a volume average particle diameter in $\mu$m of said carrier;

wherein said carrier has a volume average particle diameter of 15 to 45 $\mu$m, and contains carrier particles smaller than 22 $\mu$m at 1 to 20%, carrier particles smaller than 16 $\mu$m at 3% or less, carrier particles of 62 $\mu$m or more at 2 to 15%, and carrier particles of 88 $\mu$m or more at 2% or less.

20. A two-component developer consisting of a toner, which contains at least a resin and a colorant and to which an external additive is added, and a carrier;

wherein a number average molecular weight of said toner is 3,000 or less; wherein molecules having a molecular weight of 1,000 or less are contained at 40 number % or more; and wherein said carrier satisfies formula (1) as follows:

$$3{,}000{,}000 \leqq \sigma_{1000} \times Dc^3 \leqq 20{,}000{,}000 \quad (1)$$

wherein $\sigma_{1000}$ represents a magnetization in emu/g of the carrier at 1,000 oersted; and wherein Dc represents a volume average particle diameter in $\mu$m of said carrier;

wherein a saturation magnetization of said carrier to an applied magnetic field of 1,000 oersted is 40 to 120 emu/g, a residual magnetization is not more than 10 emu/g, and a coercive force is not more than 60 oersted.

* * * * *